United States Patent [19]

Engle

[11] 4,090,412

[45] May 23, 1978

[54] HANDBRAKE LINKAGE FOR TRANSMITTING MECHANICAL BRAKING FORCE BETWEEN ADJACENT RAIL VEHICLES

[75] Inventor: Thomas H. Engle, Cape Vincent, N.Y.

[73] Assignee: General Signal Corporation, Rochester, N.Y.

[21] Appl. No.: 783,038

[22] Filed: Mar. 30, 1977

[51] Int. Cl.[2] ..... G05G 1/04

[52] U.S. Cl. ..... 74/519; 74/469

[58] Field of Search ..... 74/469, 519

[56] References Cited

U.S. PATENT DOCUMENTS

| | | | |
|---|---|---|---|
| 2,975,869 | 3/1961 | Busch | 74/519 X |
| 3,327,552 | 6/1967 | Broders et al. | 74/469 |

*Primary Examiner*—Frank T. Yost

*Attorney, Agent, or Firm*—Pollock, Vande Sande & Priddy

[57] ABSTRACT

A linkage is disclosed which is especially adapted for use in articulated rail vehicles to ensure proper transmission of handbrake actuating force from car section to car section regardless of relative movement therebetween. Parallel bar linkages extending between car sections adjust the position of a fulcrum point to prevent changes in the location of vital linkage points, thereby avoiding unwanted brake application or release as the car sections undergo relative movement.

9 Claims, 4 Drawing Figures

HANDBRAKE LINKAGE FOR TRANSMITTING MECHANICAL BRAKING FORCE BETWEEN ADJACENT RAIL VEHICLES

BACKGROUND OF THE INVENTION

Recent years have seen the development of railway cars and roadway trailers which are of extended length relative to the cars and trailers known in the prior art. For example, in rail cars the use of cars well over one hundred feet in length is not uncommon. In railroad applications, the use of longer cars can present difficulties in situations where the car approaches the maximum length which will travel over track sections having the minimum radii of curvature now in use. To account for this, articulated rail cars have been developed which may comprise from two to as many as five or more separate sections which are permanently, flexibly joined to each other. In some types of such cars, each section is independently supported on a single axle truck at each end of the section, thus producing an articulate car which is intended for use as a large, single unit.

Such cars present rather unique problems regarding the type of braking system to be used. The recent U.S. Pat. No. 3,910,641 for Brake System for an Articulated Carrier by Thomas H. Engle, discloses one successful approach to a pneumatically controlled brake system for such a car and also discloses a hydraulically actuated handbrake. In cars where a mechanically actuated handbrake is desired, problems arise which were not addressed in the previously mentioned patent.

The common handbrake linkage used in prior art freight cars comprises a handwheel located on the exterior of the car in a position for manual actuation by a trainman or yard worker. Typically, the hand wheel tensions a chain which actuates a linkage connected to the brake beams, thereby applying the brakes. When the tension is released, the brake beams move away from their applied position due to gravity effects. When this type of linkage is adapted to multiple section, articulated cars of the type previously described, some provision must be made to transmit handbrake force between sections since it is desirable not to have a separate hand wheel for each section, for the sake of simplicity and ease of operation. If flexible connectors such as cables or chains or simple pivoted rods are run between sections to transmit handbrake force, brake application and release become unreliable and spasmodic when the articulated car is negotiating a turn. This is because the linkage in the section with the hand wheel moves toward and away from the linkage in the next section, and so on through the car, as the car turns. The connectors are thus subjected to variable forces so that a partially applied brake in a car section may be fully released or fully applied rather abruptly due to relative motion between sections. Control of the handbrake application or release thus becomes quite difficult when the articulated car is in motion.

OBJECTS OF THE INVENTION

An object of the invention is to provide a connecting linkage for use between sections of an articulated rail car which accurately transmits braking force from section to section in response to hand wheel application.

Another object of the invention is to provide such a linkage which does not transmit undesired brake applying or releasing forces due to relative movement between articulated car sections.

These objects of the invention are given only by way of example. Thus, other desirable objects and advantages inherently achieved by the invention may be apparent to those skilled in the art upon reading this disclosure. Nontheless, the scope of the invention is to be limited only by the appended claims.

SUMMARY OF THE INVENTION

The above objects and other advantages are achieved by the disclosed invention. A first link, pivotally mounted to one car section transmits handbrake force from the linkage located in that section to the linkage located in the adjacent section via a parallel bar linkage. One bar of the parallel linkage is connected to the first link and to a second link mounted in the adjacent section. The second link is pivotally mounted on a third link pivotally mounted in the adjacent section. The second link is also connected to the brake linkage located in the adjacent section. Another bar of the parallel linkage is connected between the one car section and the third link, whereby the pivot point of the second link is moved as the second link rotates on it in response to relative movement between the car sections.

DETAILED DESCRIPTION OF THE PREFERRED EMBODIMENT

Figure 1:
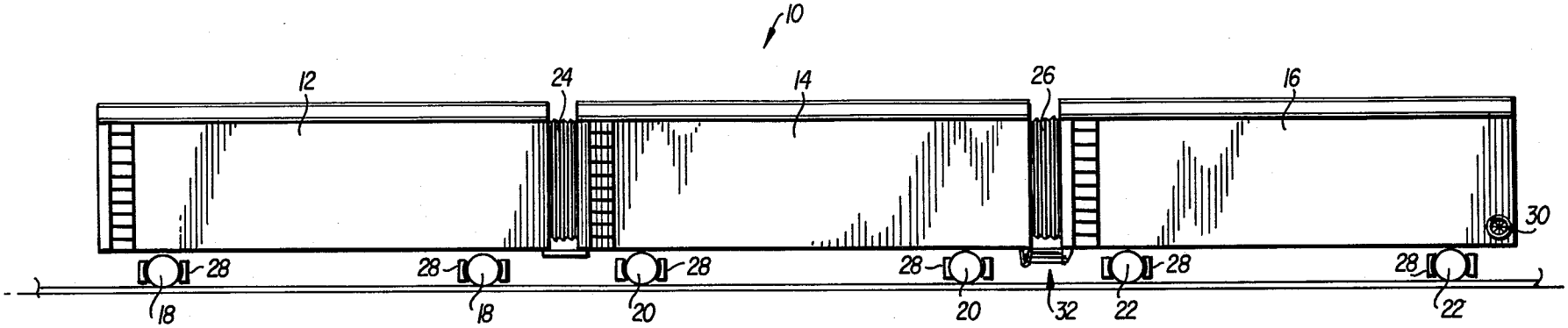
FIG. 1 shows a side view of an articulated rail car suitable for use with the invention.

There follows a detailed description of the preferred embodiment of the invention, reference being had to the drawings in which like reference numerals identify like elements of structure in each of the several Figures.

FIG. 1 shows a side view of an articulated rail car of the type previously described, for which the invention is especially suited. Such cars typically comprise a plurality of sections 12, 14 and 16 mounted on single wheel trucks 18, 20 and 22. In addition to a permanent draft connection between sections, a flexible wall or bellows 24, 26 interconnects sections 12 and 14 and sections 14 and 16, as will be understood by those skilled in the art. Brake application is achieved by moving a plurality of brake beams 28, of conventional design, into contact with the wheels of trucks 18, 20 and 22. To effect a handbrake application, a handbrake wheel 30 is provided on the exterior of the car at a convenient location for actuation by the train man or rail yard personnel. A single hand wheel is provided for actuating the handbrakes in all car sections to simplify operation. A linkage 32 is provided between car sections to transmit handbrake actuating force from section 16 to section 14. In many cases, it will not be necessary to actuate the handbrakes in all sections to achieve a sufficient application; so, a connecting linkage 32 may only be necessary between two sections as illustrated. Of course, provision of additional linkages between additional car sections is within the scope of the invention.

Figure 2:
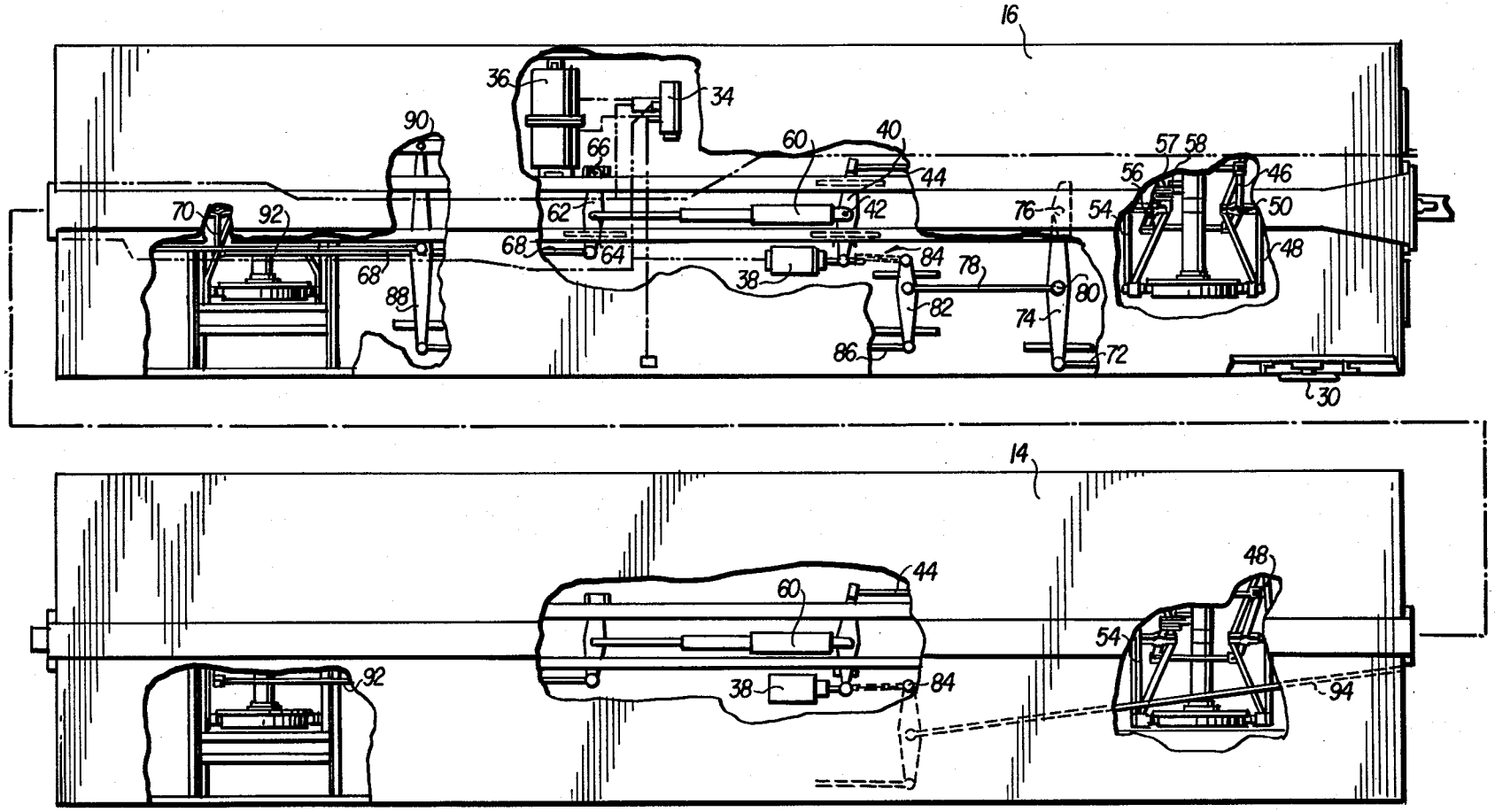
FIG. 2 shows a schematic view of the service and handbrake equipment of two adjacent car sections of such an articulated rail car.

FIG. 2 shows a partially broken away view of sections 14 and 16, illustrating their conventional rail car brake rigging as modified in accordance with the teachings of the present invention. A brake application and release valve 34 is provided which directs pressurized air from reservoirs 36 to a pneumatic actuator 38 in response to presure signals on a brake control pipe (not shown). Those skilled in the art will realize that identical pneumatic brake systems are provided in each car section. When pressurized air is delivered to pneumatic brake actuator 38, it expands and rotates a link 40 about a pivot 42 thereby pulling a further link 44 to the left, as illustrated in FIG. 2. As link 44 moves, it pulls on a brake lever 46 which is mounted in a conventional brake beam 48 by a pivot 50. The lower end of brake lever 46 is pivotally attached to a transverse link 52 which passes under the left-hand brake beam 54, on which a pivot 56 supports a second brake lever 57. Brake lever 57 is pivotally attached to the underbody of the car section by means such as a clevis 58. When the link 44 moves to the left, brake lever 46 transmits the force to link 52 which rotates brake lever 57 about a clevis 58 and brings the brake shoes of brake beam 54 into contact with one side of the truck wheels. Then, since link 52 can no longer move, brake lever 46 pivots about its lower end to pull brake beam 48 into contact with the opposite side of the truck wheels.

At this point, link 44 becomes immobile so that further expansion of actuator 38 causes link 40 to pivot about the left-hand end of link 44, thereby drawing extensible link 60 to the right as illustrated. Movement of link 60 is transmitted to link 62 via a pivot 64 thereby causing link 62 to rotate about a further pivot 66 attached to the car body. Movement of link 62 causes a link 68 to be drawn to the right as illustrated thereby rotating brake lever 70 and applying the brakes at the left hand end of the car in the manner previously described.

Figure 4:
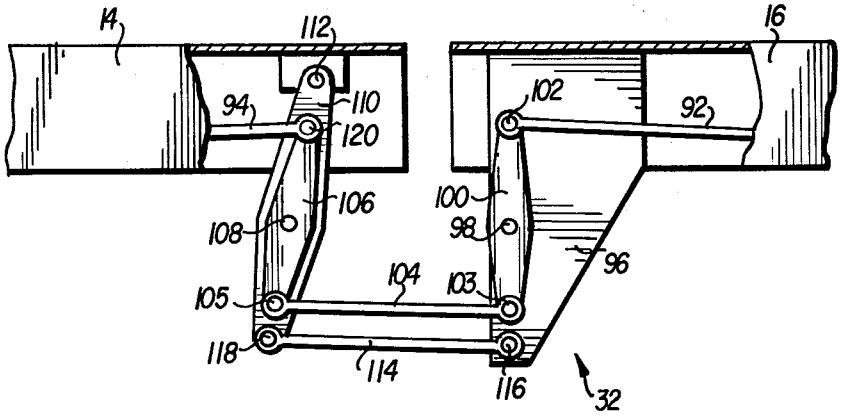
FIG. 4 shows a hand brake linkage according to the invention in the position assumed when the car sections undergo relative movement during a turn, and illustrates how the positions of certain vital links remain unchanged due to such relative motion.
Figure 3:
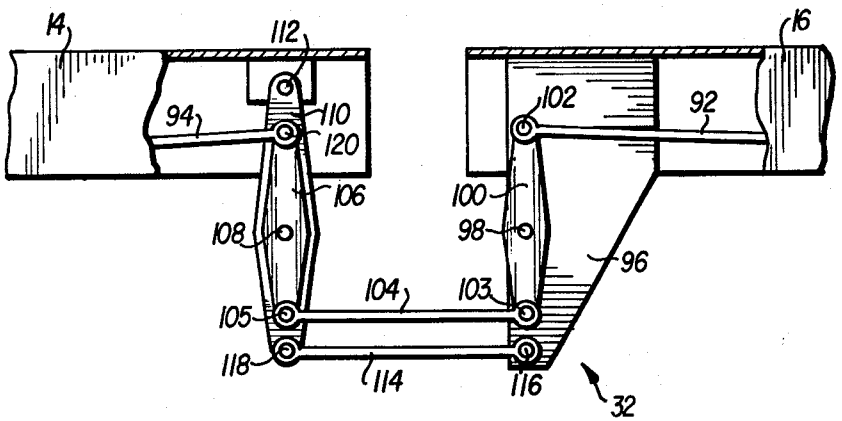
FIG. 3 shows a hand brake linkage according to the invention in its usual position where the car sections are moving on a straight track.

When a handbrake application is to be made, the train man rotats hand wheel 30 which pulls on a link 72 via a chain (not shown). Movement of link 72 causes a link 74 to rotate about a pivot 76 attached to the car body. Movement of link 74 causes a link 78 to move to the right thereby causing a link 82 to pivot and apply tension to a chain 84 which is attached to link 40. As chain 84 is tensioned, link 40 is rotated about pivot 42 and the brakes are applied in the manner previously described. When chain 84 has been tensioned, link 82 pivots about its connection point with chain 84 thereby applying force to a link 86 which extends along the car and is pivotally connected to a link 88. Link 88 rotates about a pivot 90 attached to the car body thereby applying handbrake force to a link 92 which extends to connecting linkage 32 as shown in FIGS. 3 and 4. The opposite side of linkage 32 is connected to a link 94 in the adjacent car section which is then connected to a further link 82 to actuate the handbrakes in the adjacent section in the manner previously described.

FIG. 3 illustrates the details of the connecting linkage according to the invention. A mounting plate 96 is attached to one end of car section 16. Plate 96 is illustrated extending downwardly relative to the frame of car section 16; however, those skilled in the art will realized that the plate could also be oriented at an angle or horizontally relative to the car frame without departing from the scope of the present invention. A pivot or fulcrum point 98 is provided on plate 96 on which a link 100 is pivotally mounted. Link 100 includes spaced pivots 102 and 103 which serve as force transmission points from link 92 to a link 104 which extends between car sections 14 and 16. Link 104 is pivotally attached at a further force transmission point 105 located on a link 106. Link 106 is mounted for rotation about a pivot or fulcrum point 108 which, in turn, is mounted on a link 110. Link 110 is mounted for rotation about a pivot or fulcrum point 112 located on the frame of car section 14. The lower end of link 110 is connected to mounting plate 96 by a link 114 which is pivotally mounted at force transmission points 116 and 118. As illustrated, links 104 and 114 are equal in length and extend in parallel between adjacent car sections. A force transmission point 120 transmits handbrake application force from link 106 to link 94.

In the preferred embodiment, links 100 and 106 are identical in size. Link 110 is geometrically similar to link 106 so that the distance from point 118 to fulcrum 108 bears the same ratio to the distance from 108 to point 112 as the distance from point 105 to point 108 bears to the distance from point to 108 to point 120. Since links 104 and 114 are of equal length, this arrangement of links ensures that relative movement between the adjacent car sections will adjust the position of fulcrum point 108 to maintain the positions of force transmission points 120 and 102 in constant locations relative to the frames of their respective car sections. This movement is illustrated in FIG. 4 where sections 14 and 16 have been displaced toward one another. During this relative movement, force transmission point 118 is moved about pivot 112 thereby relocating fulcrum point 108 so that force transmission points 102 and 120 remain in the same locations.

Thus, if an articulated car embodying the present invention is moving around a curved portion of track, relative movement between adjacent car sections will not cause links 92 and 94 to transmit undesired brake applying forces to the brake beams of their respective car sections. On the other hand, if the car is moving on a curved section of track while a handbrake application is being made, the brake application force transmitted by link 92 will be unerringly transmitted to link 94 regardless of relative movement between the adjacent car sections.

I claim:

1. A brake actuating linkage for use between adjacent rail cars, comprising:

a first link having first and second force transmission points, and a first fulcrum point;

a first pivot supporting said first link at said first fulcrum point at one end of one rail car;

a second link having third and fourth transmission points and a second fulcrum point;

a second pivot supporting said second link at said second fulcrum point at the opposing end of an adjacent rail car;

a third link interconnecting said second and third force transmission points;

means actuated by relative movement between the one rail car and the adjacent rail car for adjusting the position of said second pivot to maintain constant the positions of said first and fourth force transmission points as the adjacent rail cars undergo relative movement;

means for applying brake application force to said first force transmission point; and means for transmitting brake application force from said fourth transmission point.

2. A brake actuating linkage according to claim 1, wherein said means actuated by relative movement comprises:

a fourth link having a fifth force transmission point and a third fulcrum point, said second pivot being mounted on said fourth link;

a third pivot supporting said fourth link at said third fulcrum point at the opposing end of an adjacent rail car; and a fifth link pivotally interconnecting said fifth force transmission point with said one end of said one rail car.

3. A brake actuating linkage according to claim 2, wherein said second pivot is mounted on said fourth link so that the distances from said fifth force transmission point and said third fulcrum point to said second pivot bear the same ratio to each other as the distances from said third and fourth transmission points to said second fulcrum point bear to each other.

4. A brake actuating linkage according to claim 1, wherein the distances from said third and fourth transmission points to said second fulcrum point are equal to the distances from said first and second force transmission points to said first fulcrum point, respectively.

5. A brake actuating linkage according to claim 2, wherein said third and fifth links are equal in length.

6. A brake actuating linkage according to claim 3, wherein said third and fifth links are equal in length.

7. A brake actuating linkage according to claim 2, wherein the distances from said third and fourth transmission points to said second fulcrum point are equal to the distances from said first and second force transmission points to said first fulcrum point, respectively.

8. A brake actuating linkage according to claim 3, wherein the distances from said third and fourth transmission points to said second fulcrum point are equal to the distances from said first and second force transmission points to said first fulcrum point, respectively.

9. A brake actuating linkage according to claim 8, wherein said third and fifth links are equal in length.

* * * * *